US009551104B2

(12) United States Patent
Lee

(10) Patent No.: US 9,551,104 B2
(45) Date of Patent: Jan. 24, 2017

(54) FILTER DEVICE FOR WASHING MACHINE

(71) Applicant: Dongbu Daewoo Electronics Corporation, Seoul (KR)

(72) Inventor: Jae Woo Lee, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 286 days.

(21) Appl. No.: 14/119,155

(22) PCT Filed: May 3, 2013

(86) PCT No.: PCT/KR2013/003826

§ 371 (c)(1),
(2) Date: Nov. 20, 2013

(87) PCT Pub. No.: WO2013/165203

PCT Pub. Date: Nov. 7, 2013

(65) Prior Publication Data

US 2014/0102154 A1 Apr. 17, 2014

(30) Foreign Application Priority Data

May 3, 2012 (KR) ..... 10-2012-0046745
May 3, 2012 (KR) ..... 10-2012-0046746

(51) Int. Cl.
*D06F 39/10* (2006.01)
*D06F 39/08* (2006.01)
*D06F 17/06* (2006.01)

(52) U.S. Cl.
CPC ..... *D06F 39/10* (2013.01); *D06F 39/083* (2013.01); *D06F 17/06* (2013.01)

(58) Field of Classification Search
CPC ..... D06F 39/10; D06F 39/083; D06F 17/06; B01D 35/143
(Continued)

(56) References Cited

U.S. PATENT DOCUMENTS 5,863,423 A 1/1999 Shin et al.
5,931,027 A * 8/1999 Shin ..... D06F 39/10 210/136
8,037,721 B2 10/2011 Yoo et al.

FOREIGN PATENT DOCUMENTS

JP 11-300089 A 11/1999
KR 20-0161002 Y1 11/1999
(Continued)

OTHER PUBLICATIONS

International Search Report dated Jul. 18, 2013, International Application No. PCT/KR2013/003826, Korean Intellectual Property Office, Republic of Korea.
(Continued)

*Primary Examiner* — Michael Barr
*Assistant Examiner* — Rita Adhlakha

(57) ABSTRACT

A filter device for a washing machine includes a circulation flow path frame on an inner wall of a washing tub, having a first overflow path between the circulation flow path frame and the inner wall of the washing tub; and a filter unit in the circulation flow frame, having a second overflow path between the filter unit and the circulation flow path frame to communicate with the first overflow path. Wash water entering the first overflow path is discharged into the washing tub through a discharge port of the first overflow path and a discharge port of the second overflow path, and the discharge port of the second overflow path is under the discharge port of the first overflow path.

7 Claims, 17 Drawing Sheets

(58) Field of Classification Search
USPC ..... 68/18 F; 210/167.01
See application file for complete search history.

(56) References Cited

FOREIGN PATENT DOCUMENTS

| | | | |
|---|---|---|---|
| KR | 10-0263564 | B1 | 8/2000 |
| KR | 10-2005-0050272 | A | 5/2005 |
| KR | 10-2008-0081745 | A | 9/2008 |

OTHER PUBLICATIONS

Jong Soo Shin, Espacenet Bibliographic Data: Abstract of KR100263564 B1, Aug. 1, 2000, 1 page, European Patent Office, http://worldwide.espacenet.com.
Hansho Boku, Espacenet Bibliographic Data: Abstract of JPH11300089 A, Nov. 2, 1999, 2 pages, European Patent Office, http://worldwide.espacenet.com.
Jin Woo So, Korean Patent Abstracts, Abstract of 1020050050272, May 31, 2005, 2 pages, Korean Intellectual Property Rights Information Service, Republic of Korea.
Sung Chul Jeong, Korean Patent Abstracts, Abstract of 2001610020000, Nov. 15, 1999, 2 pages, Korean Intellectual Property Rights Information Service, Republic of Korea.
Sang Hee Yoo, et al., Espacenet Bibliographic Data: Abstract of KR20080081745 A, Sep. 19, 2008, 2 pages, European Patent Office, http://worldwide.espacenet.com.

* cited by examiner

FILTER DEVICE FOR WASHING MACHINE

TECHNICAL FIELD

The present invention relates to a filter device for a washing machine, and more particularly, to a filter device for a washing machine that is capable of circulating wash water while filtering foreign matter in the wash water.

BACKGROUND ART

In general, a pulsator-type washing machine rotates a washing tub when the washing tub is perpendicular to the ground. The pulsator-type washing machine washes laundry items through water streams generated when the pulsator within the washing tub rotates.

FIG. 1 is a cross-sectional view of a conventional pulsator-type washing machine.

Referring to FIG. 1, the pulsator-type washing machine 200 has a washing tub 150 contains laundry items therein and is coupled to a water storage tub 160 and an overflow path 145 communicating with a top of the washing tub 150, on one side of the washing tub 150.

Furthermore, the pulsator-type washing machine 200 includes a pulsator 110 at the bottom of the washing tub 150. The pulsator 110 generates water streams in the wash water when the pulsator 110 is rotated by a motor 170.

The pulsator 110 not only generates water streams in wash water, but also discharges part of the wash water that moves toward the edge of the washing tub 150 through a centrifugal force or the like, back into the washing tub 150 via the overflow path 145.

The overflow path 145 has a filter F coupled to a discharge end thereof, and circulates wash water back into the washing tub 150, while filtering foreign matter, such as fuzz and dirt, contained in the wash water.

The related art of the present invention has been disclosed in Korean Patent No. 10-0502010, registered on Jul. 8, 2005 and entitled "Filter for washing machine."

DISCLOSURE

Technical Problem

As a vertical overflow path 145 is on the washing tub 150 in the pulsator-type washing machine, an overflowing amount of wash water is proportional to the water level in the water storage tub 160 and the water pressure of wash water caused by the operation of the pulsator 110.

Thus, when the water level of wash water decreases, the flow rate of wash water entering the overflow path 145 decreases. Therefore, the circulation of wash water and the removal of foreign matter in the wash water cannot be smoothly performed.

The present invention is conceived to solve such problems of the related art, and an aspect of the invention is to provide a filter device for a washing machine that is capable of stably circulating wash water within a washing tub and filtering the wash water, regardless of the level of the wash water.

Technical Solution

According to an aspect of the invention, a filter device for a washing machine includes a circulation flow path frame on an inner wall of a washing tub, having a first overflow path between the circulation flow path frame and the inner wall of the washing tub; and a filter unit in the circulation flow frame having a second overflow path between the filter unit and the circulation flow path frame that communicates with the first overflow path. Wash water entering the first overflow path is discharged into the washing tub through a discharge port of the first overflow path, wash water entering the second overflow path is discharged into the washing tub through a discharge port of the second overflow path, the discharge port of the first overflow path is at the top of the washing tub, and the discharge port of the second overflow path is under the discharge port of the first overflow path.

Part of the wash water entering the first overflow path may enter the second overflow path and may be discharged into the washing tub through the discharge port of the second overflow path.

The first overflow path may include a lower flow path in a space between the inner wall of the washing tub and a bottom of the circulation flow path frame, to introduce wash water stored in the washing tub; a vertical flow path communicating with a top of the lower flow path, in a space between the inner wall of the washing tub and a middle portion of the circulation flow path frame, having a cross-sectional area smaller than the lower flow path, and extending upward to move wash water from the lower flow path in an upward direction; and a spraying flow path communicating with a top of the vertical flow path, in a space between the inner wall of the washing tub and a top of the circulation flow path frame, to discharge wash water from the vertical flow path into the washing tub, and the spraying flow path may be above the filter unit.

The first overflow path may include a lower flow path in a space between the inner wall of the washing tub and the bottom of the circulation flow path frame, to introduce wash water stored in the washing tub; a vertical flow path communicating with the top of the lower flow path part, in a space between the inner wall of the washing tub and the middle portion of the circulation flow path frame, having a smaller cross-sectional area than the lower flow path, and extending upward to move wash water from the lower flow path in the upward direction; and a spraying flow path communicating with the top of the vertical flow path, in a space between the top of the circulation flow path frame and a balancer at the top of the washing tub, to discharge wash water from the vertical flow path into the washing tub, and the spraying flow path may be above the filter unit.

The spraying flow path may include a connection flow path communicating with the top of the vertical flow path and including an internal flow path curved toward the inside of the washing tub; and a discharge flow path communicating with the connection flow path, having a smaller cross-sectional area than the connection flow path part and discharging wash water from the connection flow path part into the washing tub.

The top of the lower flow path may communicate with the vertical flow path and the second overflow path, and wash water discharged from the lower flow path may diverge into the vertical flow path and the second overflow path.

The filter unit may include a case on the circulation flow path frame having an open hole at a surface that faces the inside of the washing tub; a partition wall coupled to the case to form an outer flow path in the second overflow path between the circulation flow path frame and the partition wall, and an inner flow path of the second overflow path between the case and the partition wall; and a filter between the case and the partition wall that filters foreign matter in the wash water discharged into the washing tub through the open hole.

A bottom of the partition wall may be hinged to a bottom of the case.

The outer flow path may communicate with the top of the lower flow path and may extend upward to move wash water from the lower flow path in the upward direction, and the inner flow path may communicate with the top of the outer flow path and may extend downward to guide wash water from the outer flow path to the open hole.

According to a second aspect of the present invention, a filter device for a washing machine includes a circulation flow path frame on an inner wall of a washing tub to form a first overflow path between the inner wall of the washing tub and the circulation flow path frame; a balancer connection unit having a balancer connection flow path therein, coupled to the top of the circulation flow path frame where the first overflow path communicates with the balancer connection flow path and a balancer at the top of the washing tub; and a filter unit on the circulation flow path frame to form a second overflow path between the circulation flow path frame and the filter unit, and to communicate with the first overflow path. Wash water entering the first overflow path is discharged into the washing tub through the balancer connection flow path, wash water entering the second overflow path is discharged into the washing tub through a discharge port of the second overflow path, a discharge port of the balancer connection flow path is at the top of the washing tub, and the discharge port of the second overflow path is under the discharge port of the balancer connection flow path.

Part of the wash water entering the first overflow path may enter the second overflow path, and may be then discharged into the washing tub through the discharge port of the second overflow path.

The first overflow path may include a lower flow path in a space between the circulation flow path frame and the bottom of the inner wall of the washing tub, to introduce washing water stored in the washing tub; and a vertical flow path communicating with a top of the lower flow path, in a space between the inner wall of the washing tub and the circulation flow path frame, having a smaller cross-sectional area than the lower flow path, extending upward to move wash water from the lower flow path in the upward direction and communicating with the balancer connection flow path.

The top of the lower flow path may communicate with the vertical flow path and the second overflow path, and wash water discharged from the lower flow path may diverge into the vertical flow path and the second overflow path.

The balancer connection unit may include a connection body between the circulation flow path frame and the balancer, with the balancer connection flow path therein, the balancer connection flow path communicating with the first overflow path.

The balancer connection unit may include a lower opening at a bottom of the connection body connecting the first overflow path and the balancer connection flow path; and a side opening at a side of the connection body, connected to the balancer connection flow path and discharging wash water into the washing tub, where the side opening may have a smaller cross-sectional area than the lower opening.

The filter unit may include a case on the circulation flow path frame having an open hole in a surface that faces the inside of the washing tub; a partition wall coupled to the case to form an outer flow path in the second overflow path between the circulation flow path frame and the partition wall, and an inner flow path of the second overflow path between the partition wall and the case; and a filter between the case and the partition wall that filters foreign matter in the wash water discharged into the washing tub through the open hole.

The bottom of the washing tub may be hinged to the bottom of the case.

The outer flow path may communicate with the top of the lower flow path and may extend upward to move wash water from the lower flow path in the upward direction, and the inner flow path may communicate with the top of the outer flow path, and may extend downward to guide wash water from the outer flow path to the open hole.

Advantageous Effects

According to an embodiment of the invention, since the circulation of wash water may be realized through the first overflow path and the second overflow path, the wash water may be uniformly supplied to the upper portion and the middle portion of the washing tub.

Since wash water may be discharged from the upper part of the washing tub through the first overflow path and wash water may be discharged from the middle part of the washing tub, wash water from the bottom of the washing tub may uniformly circulate through the upper portion and the middle portion of the washing tub. The smooth circulation of wash water may improve the washing performance.

Furthermore, the first overflow path includes the discharge flow path, which allows wash water to be sprayed at high speed. Thus, the wash water may be supplied to positions remote from the inner wall of the washing tub. Therefore, as the area for supplying the wash water is increased, laundry items may be uniformly wetted with wash water, making it possible to improve the washing performance of the washing machine.

Furthermore, since the circulation of wash water may be realized through the first overflow path, the second overflow path, and the balancer connection unit, the wash water may be uniformly supplied to the upper portion and the middle portion of the washing tub.

In other words, since wash water may be discharged from the upper portion of the washing tub through the first overflow path and the balancer connection unit, wash water may be discharged from the middle portion of the washing tub, and wash water from the bottom of the washing tub may uniformly circulate through the upper portion and the middle portion of the washing tub. The smooth circulation of the wash water may improve the washing performance of the washing machine.

Furthermore, since wash water that moves through the first overflow path and the balancer connection unit is sprayed at high speed through the side opening, the wash water may be supplied to positions remote from the inner wall of the washing tub. Thus, as the area for supplying the wash water is increased, laundry items may be uniformly wetted with the wash water, which makes it possible to improve the washing performance.

Furthermore, since foreign matter contained in wash water discharged through the second overflow path are filtered through the filter, the wash water from which the foreign matter are removed may be supplied to improve the washing performance of the washing machine.

Furthermore, when the depth of wash water is low, or the water pressure or the centrifugal force from rotation of the pulsator is weak, the wash water does not reach the top of the washing tub, and the wash water may be circulated through the second overflow path in the middle portion of the washing tub. Thus, the washing performance of the washing machine may be improved.

DESCRIPTION OF DRAWINGS

The above and other aspects, features and advantages of the invention will become apparent from the following detailed description in conjunction with the accompanying drawings, in which.

BEST MODE

Embodiments of the invention will hereinafter be described in detail with reference to the accompanying drawings. It should be noted that the drawings are not to precise scale and may be exaggerated in thickness of lines or sizes of components for descriptive convenience and clarity only. Furthermore, the terms as used herein are defined by taking functions of the invention into account and can be changed according to the custom or intention of users or operators. Therefore, definition of the terms should be made according to the overall disclosures set forth herein.

Figure 2:
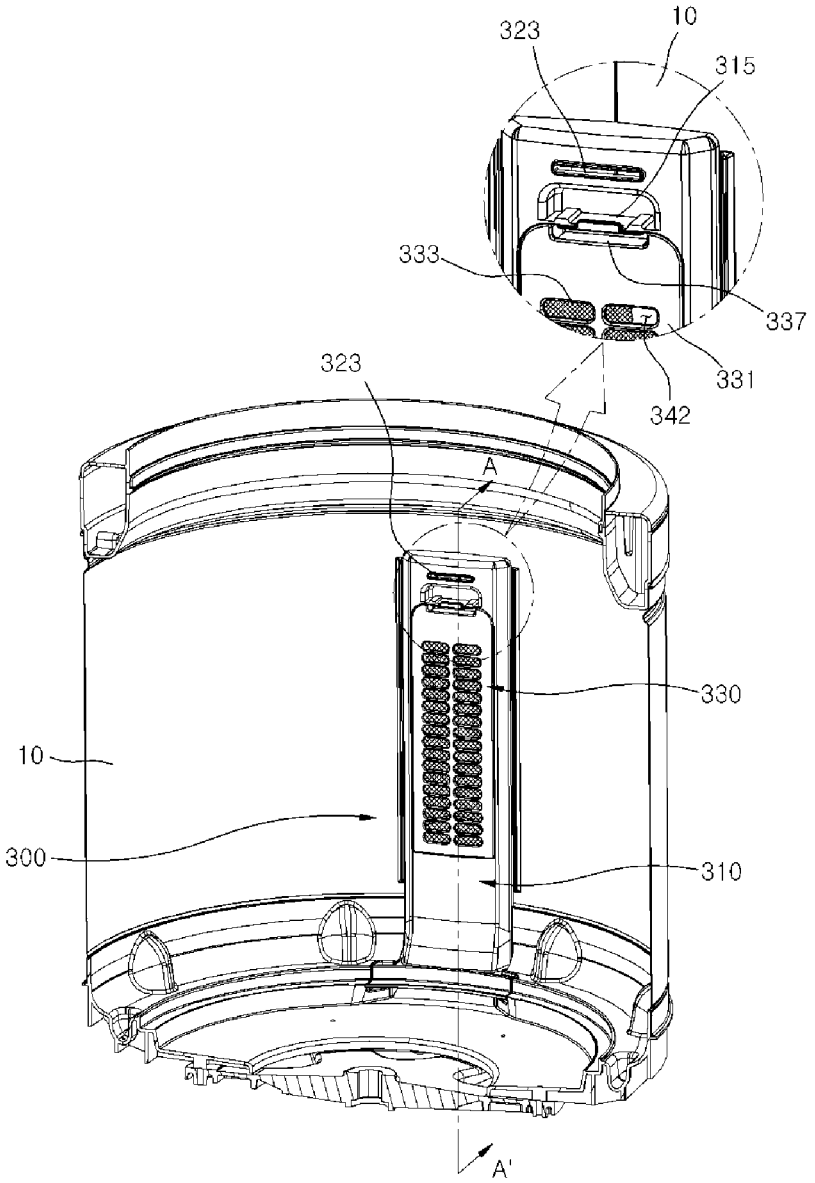
FIG. 2 is a perspective view of a filter device for a washing machine in accordance with a first embodiment of the present invention.
Figure 3:
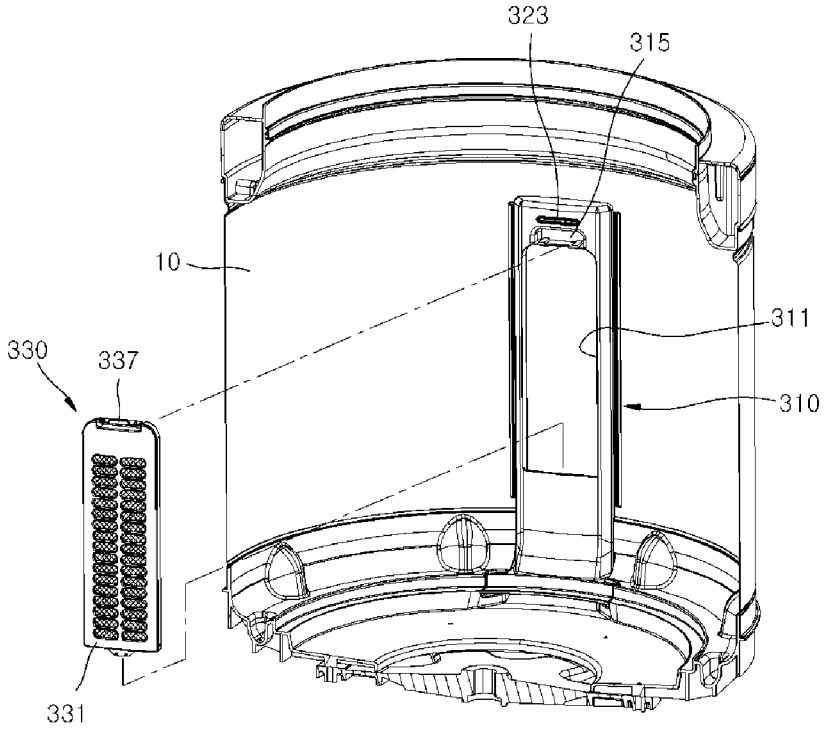
FIG. 3 is an exploded perspective view of main parts of the filter device for a washing machine in accordance with the first embodiment of the present invention.
Figure 4:
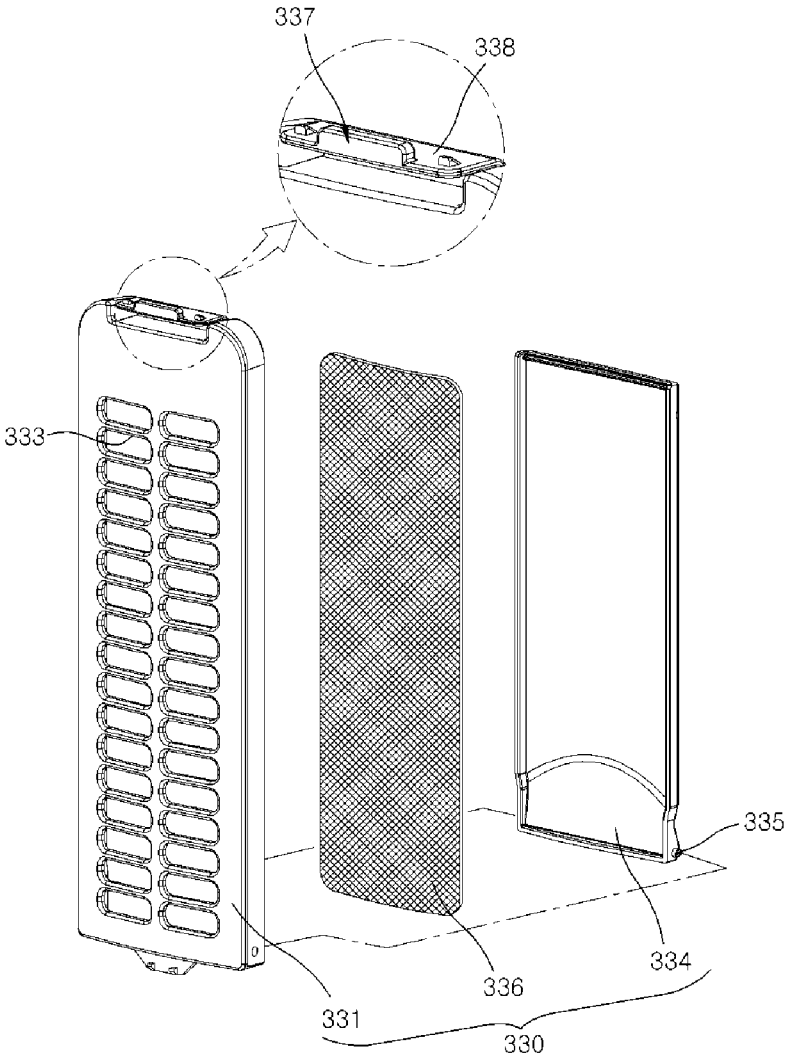
FIG. 4 is an exploded perspective view of a filter unit of the filter device for a washing machine in accordance with the first embodiment of the present invention.
Figure 5:
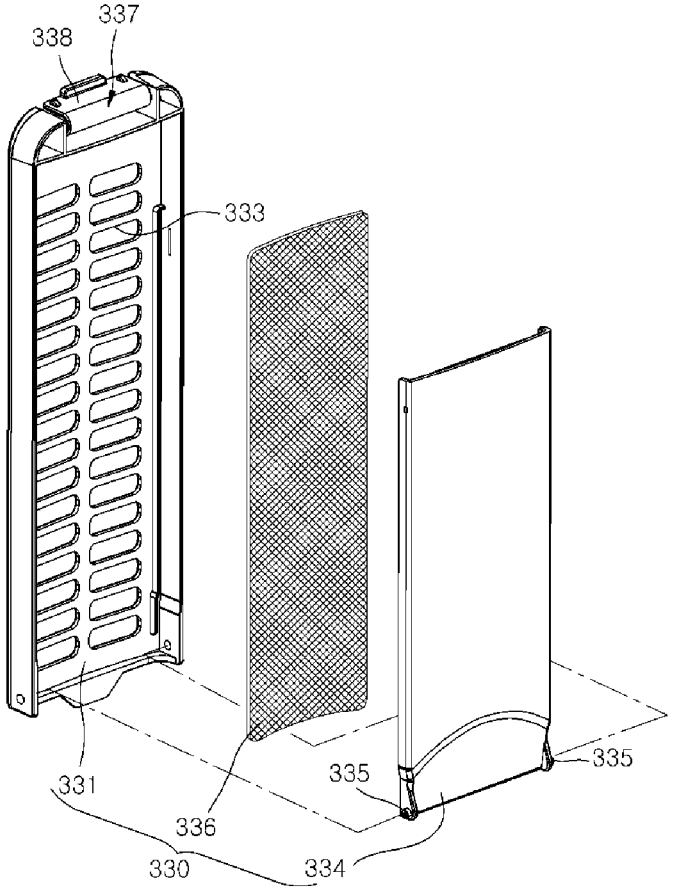
FIG. 5 is an exploded perspective view of the filter unit of the filter device for a washing machine in accordance with the first embodiment of the present invention from a different angle.
Figure 6:
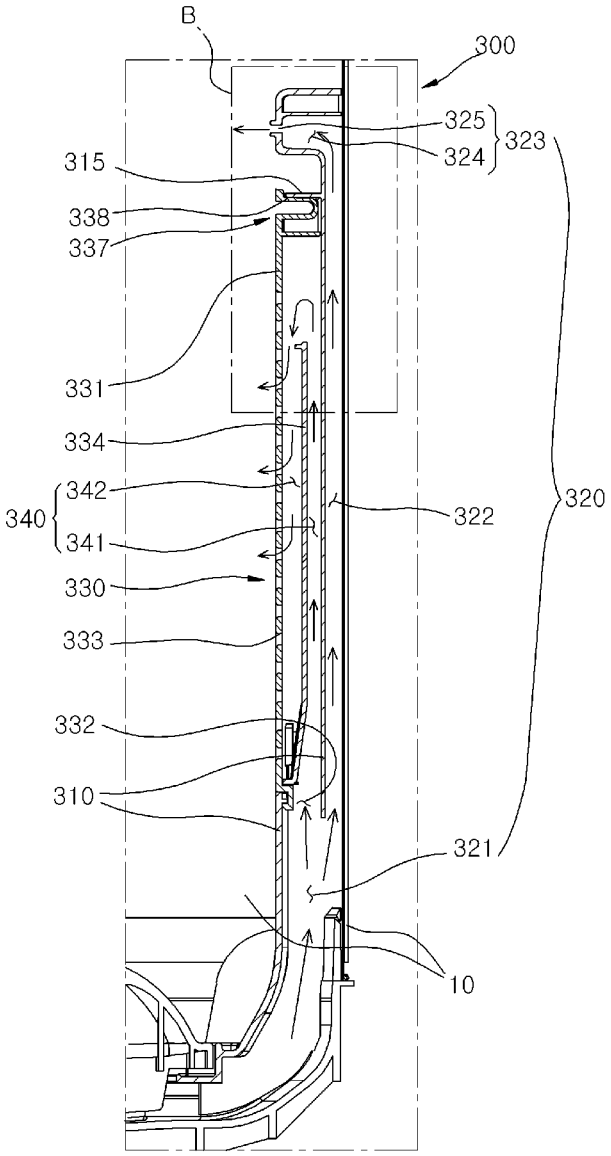
FIG. 6 is a cross-sectional view of the filter unit of the filter device for a washing machine in accordance with the first embodiment of the present invention along line A-A' of FIG. 2.
Figure 7:
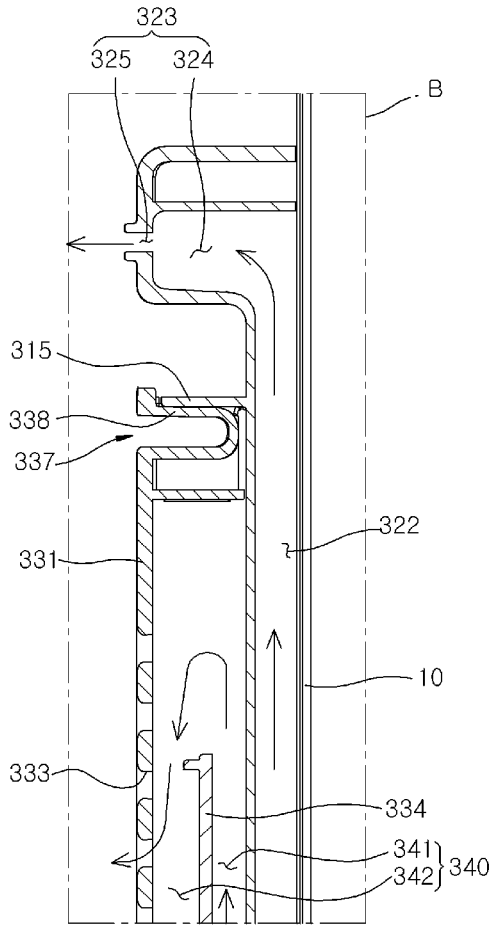
FIG. 7 is an expanded cross-sectional view of a portion B of FIG. 6.

FIG. 2 is a perspective view of a filter device for a washing machine in accordance with a first embodiment of the present invention. FIG. 3 is an exploded perspective view of main parts of the filter device for a washing machine in accordance with the first embodiment of the present invention. FIG. 4 is an exploded perspective view of a filter unit of the filter device for a washing machine in accordance with the first embodiment of the present invention. FIG. 5 is an exploded perspective view of the filter unit of the filter device for a washing machine in accordance with the first embodiment of the present invention from a different angle. FIG. 6 is a cross-sectional view of the filter unit of the filter device for a washing machine in accordance with the first embodiment of the present invention along line A-A' of FIG. 2. FIG. 7 is an expanded cross-sectional view of a portion B of FIG. 6.

Referring to FIGS. 2 and 3, the filter device 300 for a washing machine in accordance with the first embodiment of the present invention includes a circulation flow path frame 310 and a filter unit 330.

The circulation flow path frame 310 is installed on an inner wall of the washing tub 10, and formed to extend from the bottom to the top of the wash tub 10. Between the circulation flow path frame 310 and the inner wall of the washing tub 10, a first overflow path 320 is formed.

The circulation flow path frame 310 is not limited to specific structures and shapes, as long as the circulation flow path frame 310 has a hollow portion corresponding to the first overflow path 320 and between the inner wall of the washing tub 10 and the circulation flow path frame 310. Thus, the detailed descriptions for the exterior of the circulation flow path frame 310 are omitted herein.

Since the circulation flow path frame 310 has an internal structure corresponding to the structure of the first overflow path 320, the descriptions for the circulation flow path frame 310 will be replaced with the descriptions for the first overflow path 320. In the following descriptions, the term 'inner wall' indicates one surface adjacent to the inside of the washing tub 10, and the inside of the washing tub 10 indicates a space in which wash water is stored.

The first overflow path 320 forms a flow path through which wash water stored at the bottom of the washing tub 10 moves upward to the top of the washing tub 10, and discharges into the washing tub 10. The upward movement of wash water is caused by water streams and centrifugal force generated by rotation of a pulsator.

Referring to FIG. 3, when the circulation flow path frame 310 is on the inner wall of the washing tub 10, the first overflow path 320 is between the inner wall of the washing tub 10 and the circulation flow path frame 310, as illustrated in FIG. 6.

Referring to FIGS. 6 and 7, the first overflow path 320 in accordance with the first embodiment of the present invention includes a lower flow path 321, a vertical flow path 322, and a spraying flow path 323. The lower flow path 321 forms the lower portion of the first overflow path 320, the spraying flow path 323 forms the upper portion of the first overflow path 320, and the vertical flow path 322 forms the central portion of the first overflow path 320, connecting the lower flow path 321 and the spraying flow path 323.

The lower flow path 321 is formed between the inner wall of the washing tub 10 and the bottom of the circulation flow path frame 310, and wash water stored in the washing tub 10 is entering the first overflow path 320 through the lower flow path 321. The bottom of the lower flow path 321 is open to allow in wash water.

The vertical flow path 322 communicates with the top of the lower flow path 321, and is formed in a space between the inner wall of the washing tub 10 and the central portion of the circulation flow path frame 310. The vertical flow path 322 has a smaller cross-sectional area than the lower flow path 321.

The wash water reaching the top of the lower flow path 321 moves upward through the first overflow path 320, or more particularly, the vertical flow path 322 or the second overflow path 340. That is, the flow path of wash water is divided into the vertical flow path 322 and a second overflow path 340 at the top of the lower flow path 321.

Thus, wash water discharged from the lower flow path 321, but not entering the second overflow path 340, moves upward through the vertical flow path 322. On the other hand, wash water discharged from the lower flow path 321, but not entering the vertical flow path 322, flows upward through the second overflow path 340.

The spraying flow path 323 communicates with the top of the vertical flow path 322, and is formed in a space between the inner wall of the washing tub 10 and the top of the circulation flow path frame 310. The spraying flow path 323 is above the filter unit 330. Thus, wash water reaching the spraying flow path 323 through the vertical flow path 322 is discharged into the washing tub 10 through the spraying flow path 323 above the filter unit 330. That is, the first overflow path 320 has a discharge port above a discharge port of the second overflow path 340. The spraying flow path 323 is on the circulation flow path frame 310 and has an open hole.

The spraying flow path 323 in accordance with the first embodiment of the present invention includes a connection flow path 324 and a discharge flow path 325.

The connection flow path 324 communicates with the top of the vertical flow path 322, and extends toward the inside of the washing tub 10 at the top of the vertical flow path 322. More specifically, the connection flow path 324 has an internal flow path curved at a right angle at the top of the vertical flow path 322 towards the inside of the washing tub 10.

Thus, when the wash water reaching the top of the vertical flow path 322 enters the connection flow path 324, the directional flow of the wash water changes toward the inside of the washing tub 10. Therefore, the wash water is closer to the washing tub 10.

The discharge flow path 325 communicates with an end of the connection flow path 324, having a smaller cross-sectional area than the connection flow path 324. Since the wash water reaching the end of the connection flow path 324 is sprayed into the washing tub 10 through the discharge flow path 325 having a smaller cross-sectional area than the connection flow path part 324, the wash water may be sprayed at high speed. Thus, the area of the wash water may be increased. In the first embodiment of the present invention, the discharge flow path 325 serves as the discharge port of the first overflow path 320.

Thus, the wash water may be supplied a distance across a wider area, laundry items within the washing tub 10 may be uniformly sprayed with the wash water.

Referring to FIGS. 2 and 3, the filter unit 330 is installed on the circulation flow path frame 310, and includes the second overflow path 340 formed therein. The filter unit 330 has an opening 332 communicating with the first overflow path 320 (e.g., FIG. 6).

Referring to FIGS. 4 and 5, the filter unit 330 in accordance with the first embodiment of the present invention includes a case 331, a partition wall 334, and a filter 336.

The case 331 has a space in which the second overflow path 340 is formed, having a frame which may be mounted on the inner wall of the circulation flow path frame 310. The case 331 has the opening 332 formed at the bottom thereof, through which wash water may be introduced.

The case 331 has an open hole 333 formed at a surface facing the washing tub 10, at the inner wall thereof, such that wash water is discharged into the washing tub 10 through the hole 333. The case 331 may include a plurality of open holes 333 formed from the top to the bottom of the case 331. In the first embodiment of the present invention, the open holes 333 serve as the discharge ports of the second overflow path 340.

In the first embodiment of the present invention, the case 331 is in a rectangular parallelepiped shape without the outer wall and bottom wall, having a space in which the second overflow path 340 is formed.

The circulation flow path frame 310 has a depression 311 formed thereon. The depression 311 has a size corresponding to the shape of the case 331, such that the case 331 may be mounted in the depression 311. Furthermore, the circulation flow path frame 310 has an assembling bump 315 formed at the top of the depression 311, to horizontally protrude to the inside of the washing tub 10. Furthermore, the circulation flow path frame 310 has a locking bump (not illustrated) formed at the bottom of the depression 311, to protrude upward.

The case 331 includes a detachable assembling 337 formed at the top thereof, having a flexible width. Furthermore, the case includes a protruding bump (not illustrated) formed at the bottom thereof.

The case 331 is assembled by the following process. First, the protruding bump is locked into the locking bump of the circulation flow path frame 310, and the case 331 is pushed into the depression 311 of the circulation flow path frame 310. As illustrated in FIG. 2, the case 331 may be installed on the circulation flow path frame 310. The detachable assembling part 337 is closely attached to the assembling bump 315 at the bottom of the assembling bump 315.

The detachable assembling part 337 has a shape curved from the outer wall towards the inner wall of the case 331. According to the degree the detachable assembling part 337 is curved, the width of a hollow portion formed in the detachable assembling part 337, that is, the width expanded and contracted in a vertical direction may be determined.

The detachable assembling part 337 has a contact part 338 contacted with the assembling bump 315. The vertical length of the contact part 338 may be changed through a pressure applied in a vertical direction. Thus, when a downward pressure is applied to the detachable assembling part 337, to reduce the vertical length of the detachable assembling part 337, the contact part 338 is separated from the assembling bump 315, and the filter unit 330 may be conveniently separated from the depression 31 of the circulation flow path frame 310.

Furthermore, since the contact part 338 elastically presses the assembling bump 315 when the filter unit 330 is mounted in the depression 311 of the circulation flow path frame 310, the filter unit 330 and the circulation flow path frame 310 may be reliably coupled to each other without a gap therebetween.

Referring to FIGS. 4 to 6, the partition wall 334 is in a plate shape, and coupled to the case 331, between the partition wall 334 and the case 331. The space between the case 331 and the partition wall 334 forms an inner flow path 342 of the second overflow path 340.

The partition wall 334 is spaced from the circulation flow path frame 310, such that a space is formed between the partition wall 334 and the circulation flow path frame 310. The space between the partition wall 334 and the circulation flow path frame 310 forms an outer flow path 341 of the second overflow path 340.

As the partition wall 334 is between the circulation flow path frame 310 and the case 331, the outer flow path 341 of the second overflow path 340 is between the partition wall 334 and the circulation flow path frame 310, and the inner flow path 342 of the second overflow path 340 is between the case 331 and the partition wall 334.

The partition wall 334 is to have a space from the top of the case 331. Thus, wash water entering the case 331 moves through the outer flow path 341 of the second overflow path 340. The wash water is to the space between the top of the case 331 and the partition wall 334, and moved through the inner flow path 342 of the second overflow path 340.

The wash water moves upward through the outer flow path 341 of the second overflow path 340. Then, the wash water moves downward while the directional flow of the wash water changes to the inner flow path 342 of the second overflow path 340.

The outer flow path 341 of the second overflow path 340 is formed through the space between the circulation flow path frame 310 and the partition wall 334, and the inner flow path 342 of the second overflow path 340 is formed through the space between the partition wall 334 and the case 331.

A filter 336 has a mesh structure capable of filtering foreign matter contained in the wash water. The filter 336 is between the case 331 and the partition wall 334 facing the open holes 333. The filter 336 is on the inner flow path 342 of the second overflow path 340.

Thus, the foreign matter contained in the wash water entering the inner flow path 342 of the second overflow path 340 are filtered through the filter 336, and the wash water is discharged to the outside of the case 331 through the open holes 333 and supplied into the washing tub 10. As a result, the filtered foreign matter are collected in the inner flow path 342 of the second overflow path 340.

As the plurality of open holes 333 are formed in a vertical direction, the wash water may be discharged through some of the open holes 333, even though some of the open holes 333 are clogged with the foreign matter collected through the filter 336. As the plurality of open holes 333 are formed, the discharging wash water and the filtering of foreign matter may be continuously performed while foreign matter are collected.

The partition wall 334 is rotatably coupled to the case 331. More specifically, the partition wall 334 has a hinge coupling part 335 formed at the bottom thereof, such that the bottom of the partition wall 334 is rotatably hinged or coupled to the bottom of the case 331.

Thus, as the partition wall 334 is rotated in a direction away from the case 331 when the filter unit 330 is separated from the circulation flow path frame 310, the foreign matter collected by the filter 336 may be conveniently exposed.

When the partition wall 334 is pulled back to be separated from the inner wall of the case 331, the foreign matter collected through the filter unit 330 may be exposed to the outside. Thus, the collected foreign matter may be easily and quickly removed. Furthermore, the inside of the filter unit 330 may be easily and quickly cleaned.

Referring to FIGS. 3, 6, and 7, the flow path of wash water has one flow path at the lower flow path 321, but is divided into the first and second overflow paths 320 and 340 at the top of the lower flow path 321.

The flow path of wash water is divided into the first and second overflow paths 320 and 340 by the inner wall of the circulation flow path frame 310. Based on FIG. 6, a right side of the inner wall of the circulation flow path frame 310 forms the first overflow path 320, and a left side of the inner wall of the circulation flow path frame 310 forms the second overflow path 340.

Some of the wash water reaching the top of the lower flow path 321 moves to the top of the washing tub 10 through the vertical flow path 322 of the first overflow path 320, and then discharged into the washing tub 10. Some of the wash water reaching the top of the lower flow path 321 moves to the middle portion of the washing tub 10, located at a lower position than the discharge flow path 325 of the first overflow path 320, through the second overflow path 340, and then discharged into the washing tub 10.

Referring to FIG. 3, when the filter unit 330 is installed on the inner wall of the circulation flow path frame 310, the second overflow path 340 is between the inner wall of the circulation flow path frame 310 and the case 331 of the filter unit 330, as illustrated in FIG. 6.

Referring to FIGS. 6 and 7, the second overflow path 340 in accordance with the first embodiment of the present invention includes the outer flow path 341 and the inner flow path 342.

The outer flow path 341 is formed through the space between the inner wall of the circulation flow path frame 310 and the partition wall 334. The wash water reaching the top of the lower flow path 321 is entering the outer flow path 341 through the opening 332 formed at the bottom of the filter unit 330, and moves upward through the outer flow path 341.

The inner flow path 342 is formed through the space between the partition wall 334 and the case 331. The directional flow of the wash water moves upward through the outer flow path 341, then changes 180 degrees while the wash water collides with the case 331 at the top of the case 331. The flow direction of the wash water moves upward on the outer flow path 341, then changes downward direction, while the wash water collides with the case 331 at the top of the case 331. Then, the wash water moves downward through the inner flow path 342 and is supplied into the washing tub 10 through the open holes 333, while being filtered through the filter 336.

In accordance with the first embodiment of the present invention, since the circulation of wash water may be realized through the first and second overflow paths 320 and 340, the wash water may be uniformly supplied to the upper portion and the middle portion of the washing tub 10. Wash water may be discharged from the upper portion of the washing tub 10 through the first overflow path 320, and wash water may be discharged from the middle portion of the washing tub 10 through the second overflow path 340. Thus, wash water from the bottom of the washing tub 10 may be uniformly circulated through the upper portion and the middle portion of the washing tub 10.

Furthermore, since the first overflow path 320 includes the discharge flow path 325, wash water may be sprayed at high speed. Thus, the wash water may be supplied to various positions within the inner wall of the washing tub 10. As the area of the wash water is increased, laundry items may be uniformly sprayed to thereby improve the washing performance.

Furthermore, since foreign matter contained in the wash water are filtered through the filter 336, the wash water from which the foreign matter is may be supplied to improve the washing performance of the washing machine.

When the depth of wash water is low, or a water pressure or centrifugal force formed by rotation of the pulsator is weak, the wash water does not reach the top of the washing tub 10, the wash water may be circulated through the second overflow path 340 formed in the middle portion of the washing tub 10. Thus, the washing performance of the washing machine may be improved.

An exemplary filter device for a washing machine in accordance with a second embodiment of the present invention will be described with reference to the accompanying drawings. For convenience of description, components having the same structures and operations as those of the first embodiment of the present invention will be represented by like reference numerals, and the detailed descriptions thereof are omitted herein.

Figure 8:
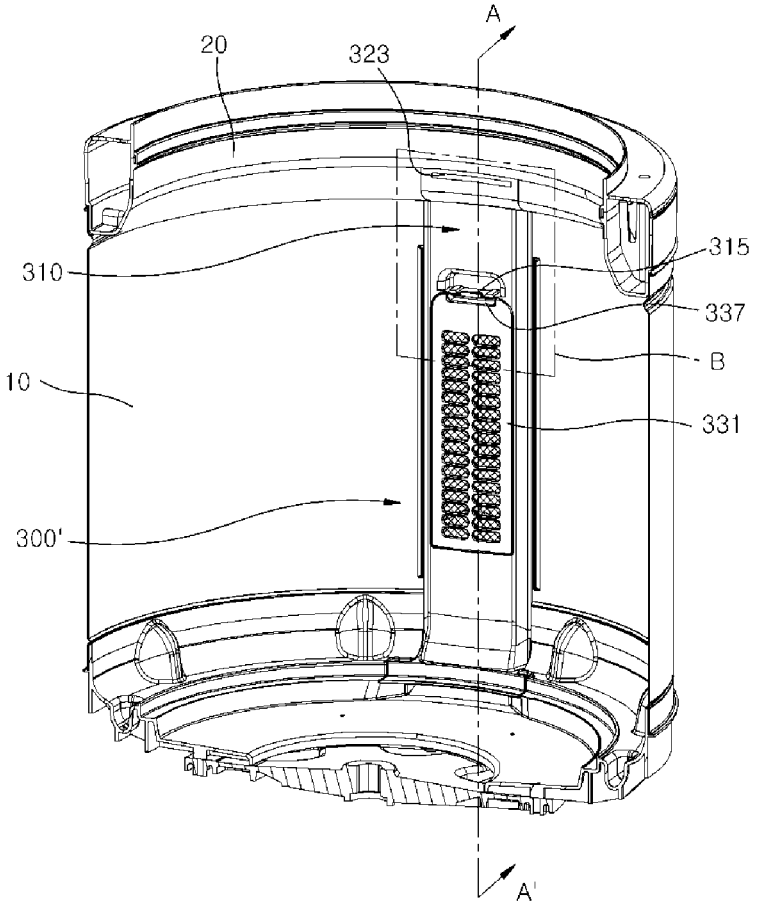
FIG. 8 is a perspective view of a filter device for a washing machine in accordance with a second embodiment of the present invention.
Figure 9:
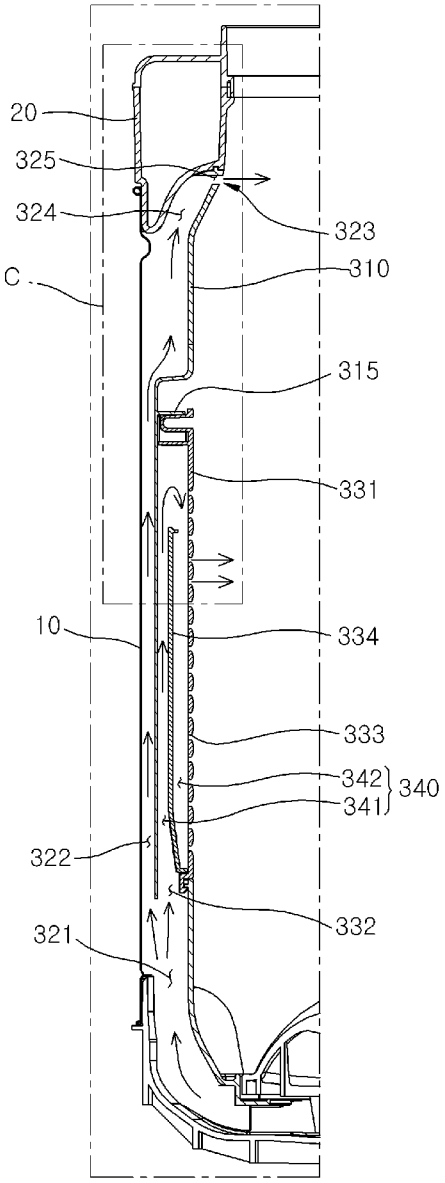
FIG. 9 is a cross-sectional view of a filter unit of the filter device for a washing machine in accordance with the second embodiment of the present invention.
Figure 10:
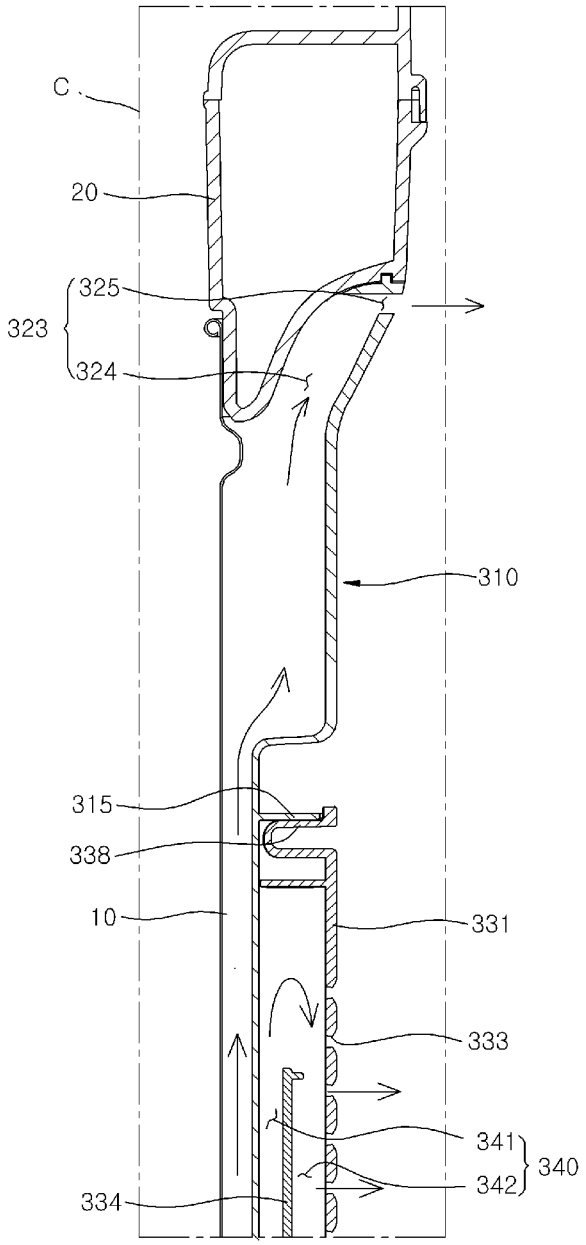
FIG. 10 is a cross-sectional view of a portion B of FIG. 9.

FIG. 8 is a perspective view of another exemplary filter device for a washing machine in accordance with a second embodiment of the present invention. FIG. 9 is a cross-sectional view of another exemplary filter unit of the filter device for a washing machine in accordance with the second embodiment of the present invention. FIG. 10 is a cross-sectional view of a portion B of FIG. 9.

Referring to FIGS. 8 to 10, a filter device 300' for a washing machine in accordance with the second embodiment of the present invention includes a circulation flow path frame 310 and a filter unit 330.

The circulation flow path frame 310 is on an inner wall of the washing tub 10, and extends from the bottom to the top of the wash tub 10. At a first overflow path 320 is formed between the circulation flow path frame 310 and the inner wall of the washing tub 10, and between the circulation flow path frame 310 and a balancer 20. The balancer 20 is at the top of the washing tub 10.

The circulation flow path frame 310 is not limited to specific structures and/or shapes, as long as the circulation flow path frame 310 has a hollow portion corresponding to the first overflow path 320 and formed between the inner wall of the washing tub 10 and the balancer 20. The detailed descriptions for the exterior and the like of the circulation flow path frame 310 are omitted herein.

Since the internal structure of the circulation flow path frame 310 corresponds to the structure of the first overflow path 320, the descriptions for the circulation flow path frame 310 will be replaced with the descriptions for the first overflow path 320.

The first overflow path 320 forms a flow path through which wash water stored at the bottom of the washing tub 10 moves upward to the top of the washing tub 10 and then discharged into the washing tub 10.

When the circulation flow path frame 310 is on the inner wall of the washing tub 10, the top of the circulation flow path frame 310 meets the bottom of the balancer 20. The first overflow path 320 is between the circulation flow path frame 310 and the inner wall of the washing tub 10, and between the circulation flow path frame 310 and the balancer 20.

The first overflow path 320 in accordance with the second embodiment of the present invention includes a lower flow path 321, a vertical flow path 322, and a spraying flow path 323. The lower flow path 321 forms the lower portion of the first overflow path 320. The spraying flow path 323 forms the upper portion of the first overflow path 320. The vertical flow path 322 forms the middle portion of the first overflow path 320, connecting the lower flow path 321 and the spraying flow path 323.

The lower flow path 321 is between the inner wall of the washing tub 10 and the bottom of the circulation flow path frame 310. The wash water stored in the washing tub 10 is entering the first overflow path 320 through the lower flow path 321. The bottom of the lower flow path 321 is open to allow wash water.

The vertical flow path 322 communicates with the top of the lower flow path 321, and is between the inner wall of the washing tub 10 and the middle portion of the circulation flow path frame 310. The vertical flow path 322 has a smaller cross-sectional area than the lower flow path 321.

The wash water reaching the top of the lower flow path 321 moves upward through the first overflow path 320, or more particularly, the vertical flow path 322 or the second overflow path 340. The flow path of wash water is divided into the vertical flow path 322 and the second overflow path 340 at the top of the lower flow path 321.

Thus, wash water discharged from the lower flow path 321, not entering the second overflow path 340, is introduced upward through the vertical flow path 322. Alternatively, wash water discharged from the lower flow path 321, not entering the vertical flow path 322, moves upward through the second overflow path 340.

The spraying flow path 323 communicates with the top of the vertical flow path 322, and is formed between the bottom of the balancer 20 and the top of the circulation flow path frame 310. The spraying flow path 323 is at the top of the filter unit 330. Thus, wash water reaching the spraying flow path 323 through the vertical flow path 322 is discharged into the washing tub 10 through the spraying flow path 323 at the top of the filter unit 330. The first overflow path 320 has a discharge port above a discharge port of the second overflow path 340. The spraying flow path 323 forms an open hole on the circulation flow path frame 310.

The spraying flow path 323 in accordance with the second embodiment of the present invention includes a connection flow path 324 and a discharge flow path 325.

The connection flow path 324 communicates with the top of the vertical flow path 322, and extends toward the inside of the washing tub 10 at the top of the vertical flow path 322. More specifically, the connection flow path 324 is in the space between the bottom of the balancer 20 and the top of the circulation flow path frame 310 at the top of the vertical flow path 322, and has an internal flow path curved at a right angle at the top of the vertical flow path 322 towards the inside of the washing tub 10.

Thus, while wash water reaching the top of the vertical flow path 322 enters the connection flow path 324, the directional flow of the wash water is changes toward the inside of the washing tub 10. Therefore, the wash water is closer to the washing tub 10.

The discharge flow path 325 communicates with an end of the connection flow path 324, and ha a smaller cross-sectional area than the connection flow path 324. Since the wash water reaching the end of the connection flow path 324 is sprayed into the washing tub 10 through the discharge flow path 325 which has a smaller cross-sectional area than the connection flow path 324, the wash water may be sprayed at a high speed. Thus, the area supplied with wash water may be increased. In the second embodiment of the present invention, the discharge flow path 325 serves as the discharge port of the first overflow path 320.

Thus, since wash water may be supplied a long distance across a wide area, laundry items within the washing tub 10 may be uniformly wetted with the wash water.

The flow path of wash water has one flow path at the lower flow path 321, but is divided into the first and second overflow paths 320 and 340 at the top of the lower flow path 321.

The flow path of wash water is divided into the first and second overflow paths 320 and 340 by the inner wall of the circulation flow path frame 310. That is, the right side of the inner wall of the circulation flow path frame 310 forms the first overflow path 320, and the left side of the inner wall of the circulation flow path frame 310 forms the second overflow path 340.

Some of the wash water reaching the top of the lower flow path 321 moves to the top of the washing tub 10 through the vertical flow path 322 of the first overflow path 320, and then discharges into the washing tub 10. Some of the wash water reaching the top of the lower flow path 321 moves to the middle portion of the washing tub 10, at a lower position than the discharge flow path 325 of the first overflow path 320, through the second overflow path 340, and then discharges into the washing tub 10.

In accordance with the second embodiment of the present invention, since the circulation of wash water may be realized through the first overflow path 320 and the second overflow path 340, the wash water may be uniformly supplied to the upper portion and the middle portion of the washing tub 10. The wash water may be discharged from the upper portion of the washing tub 10 through the first overflow path 320, and wash water may be discharged from the middle portion of the washing tub 10 through the second overflow path 340. Thus, wash water from the bottom of the washing tub 10 may be uniformly circulated through the upper portion and the middle portion of the washing tub 10.

Furthermore, since the first overflow path 320 includes the discharge flow path 325, wash water may be sprayed at a high speed. Thus, the wash water may be supplied to positions remote from the inner wall of the washing tub 10. Furthermore, as the area supplied with wash water is increased, laundry items may be uniformly sprayed with the wash water, making it possible to improve the washing performance of the washing machine.

Furthermore, since foreign matter contained in the wash water discharged through the second overflow path 340 are filtered using the filter 336, the wash water from which the foreign matter is removed may be supplied to improve the washing performance of the washing machine.

Furthermore, even when the depth of wash water is low, or a water pressure or centrifugal force from rotation of the pulsator is weak and the wash water does not reach the top of the washing tub 10, the wash water may be circulated through the second overflow path 340 in the middle portion of the washing tub 10. Thus, the washing performance of the washing machine may be improved.

Figure 1:
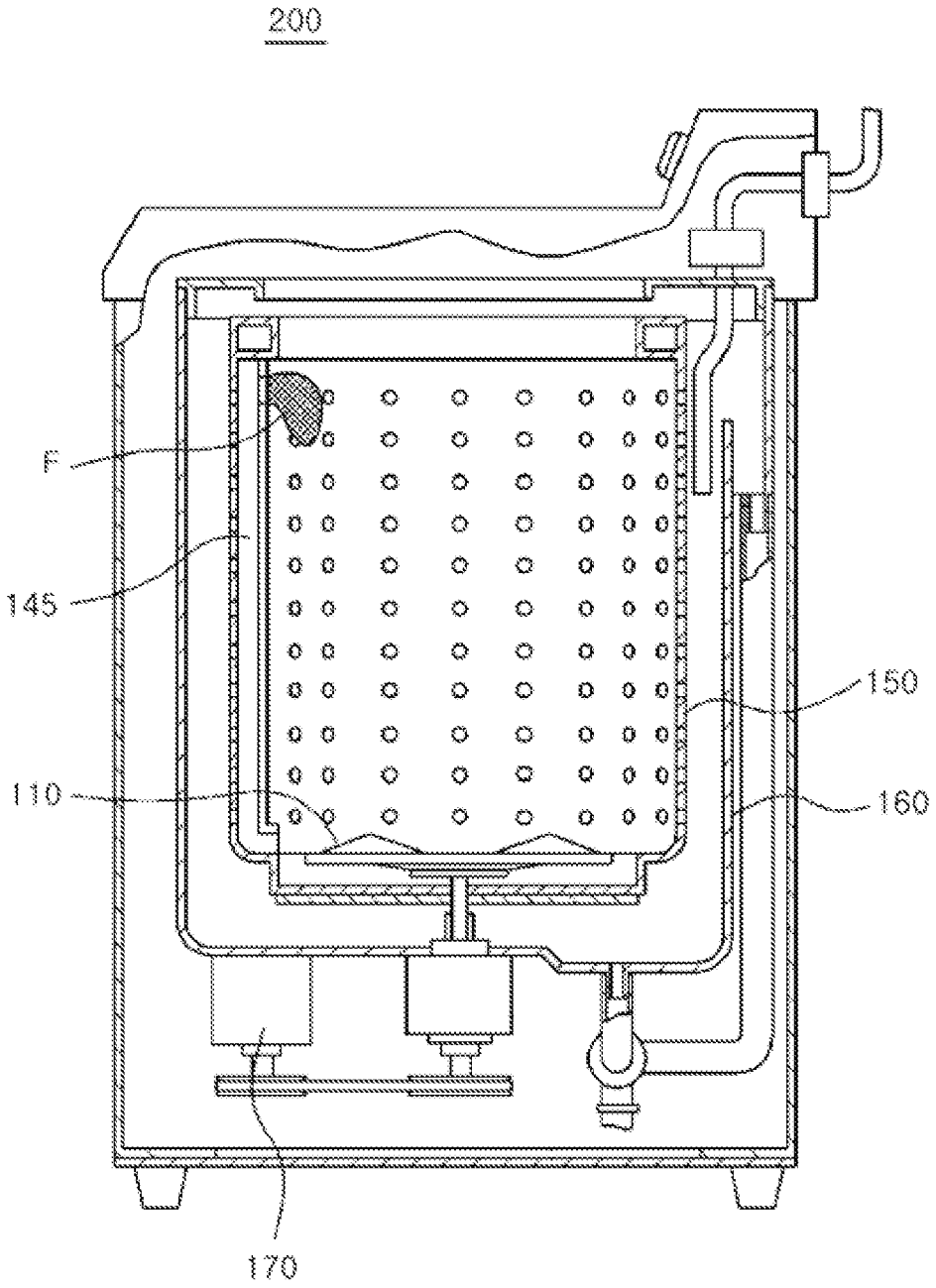
FIG. 1 (PRIOR ART)
FIG. 1 is a cross-sectional view of a conventional pulsator-type washing machine.
Figure 11:
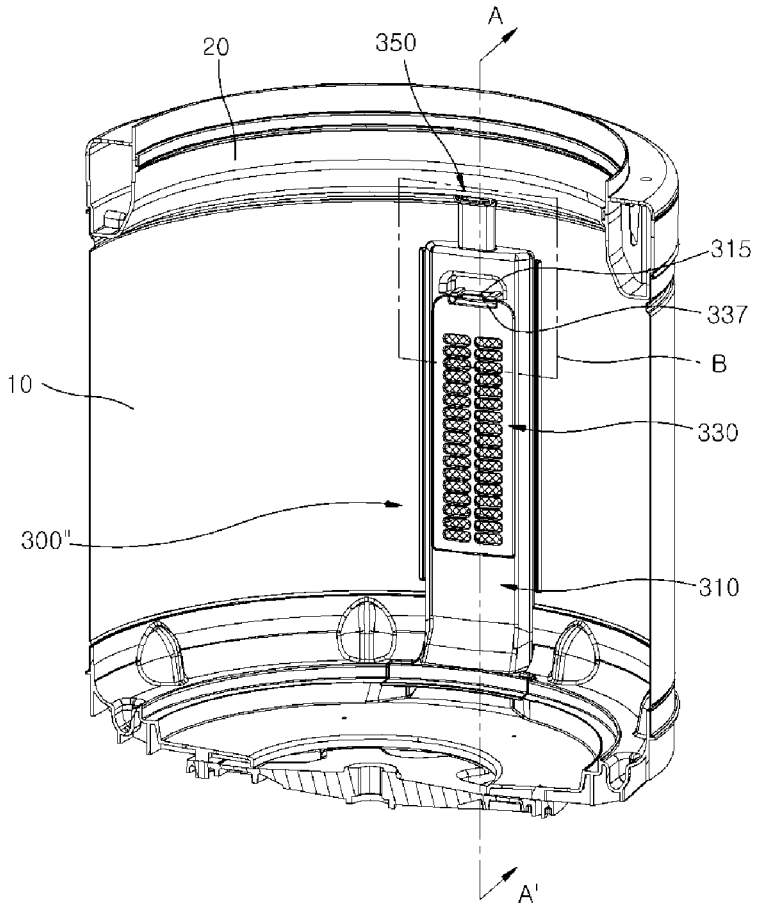
FIG. 11 is a perspective view of a filter device for a washing machine in accordance with a third embodiment of the present invention.
Figure 12:
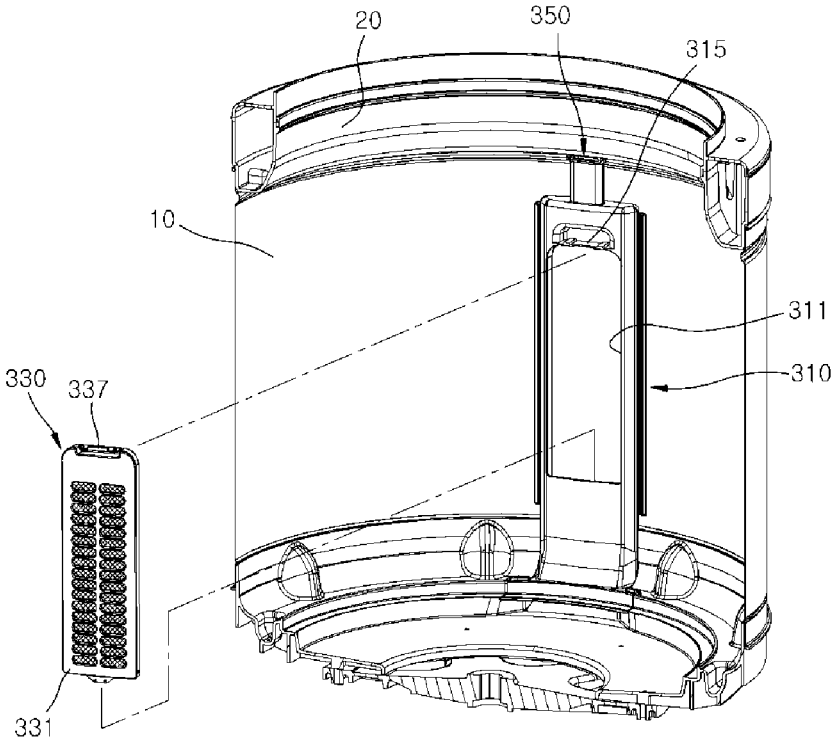
FIG. 12 is an exploded perspective view of main parts of the filter device for a washing machine in accordance with the third embodiment of the present invention.
Figure 13:
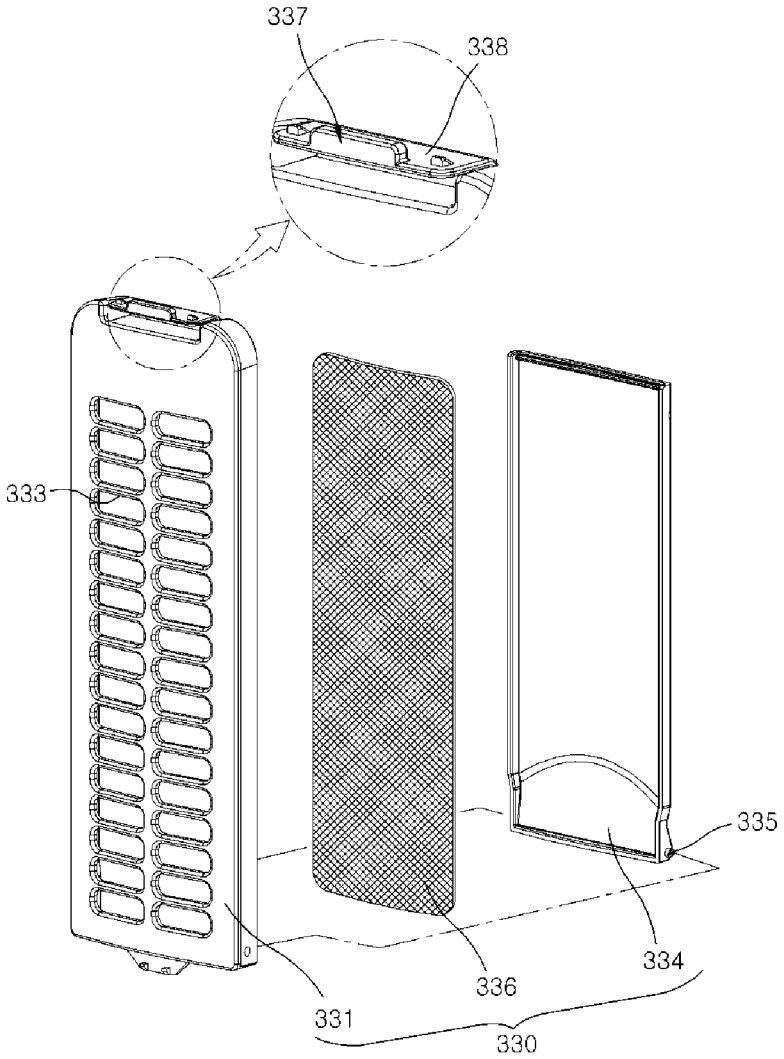
FIG. 13 is an exploded perspective view of a filter unit of the filter device for a washing machine in accordance with the third embodiment of the present invention.
Figure 14:
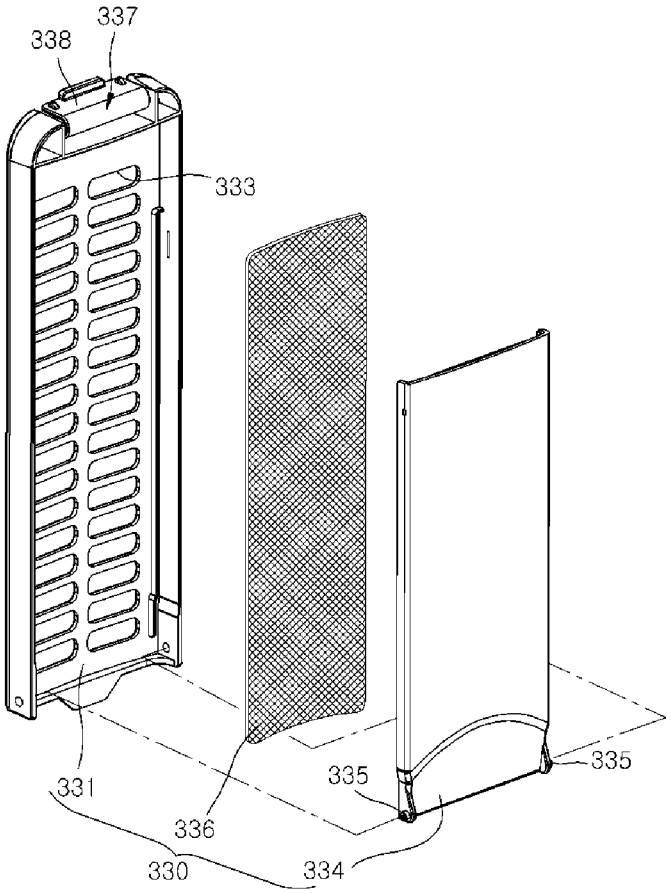
FIG. 14 is an exploded perspective view of the filter unit of the filter device for a washing machine in accordance with the third embodiment of the present invention from a different angle.

FIG. 8 is a perspective view of a filter device for a washing machine in accordance with a third embodiment of the present invention. FIG. 9 is an exploded perspective view of main parts of the filter device for a washing machine in accordance with the third embodiment of the present invention. FIG. 10 is an exploded perspective view of a filter unit of the filter device for a washing machine in accordance with the third embodiment of the present invention. FIG. 11 is an exploded perspective view of the filter unit of the filter device for a washing machine in accordance with the third embodiment of the present invention from a different angle. FIG. 12 is a perspective view of a portion B of FIG. 1. FIG. 13 is a cross-sectional view of the filter unit of the filter device for a washing machine in accordance with the third embodiment of the present invention along line A-A' of FIG. 1. FIG. 14 is an exploded cross-sectional view of a portion C of FIG. 13.

Referring to FIGS. 11 and 12, the filter device 300" for a washing machine in accordance with the third embodiment of the present invention includes a circulation flow path frame 310, a balancer connection unit 350, and a filter unit 330.

The circulation flow path frame 310 is on an inner wall of the washing tub 10, and extends from the bottom to the top of the wash tub 10. Between the circulation flow path 310 and the inner wall of the washing tub 10, a first overflow path 320 is formed.

The circulation flow path frame 310 is not limited to specific structures and shapes, as long as the circulation flow path frame 310 has a hollow portion corresponding to the first overflow path 320 and between the inner wall of the washing tub 10 and the circulation flow path frame 310. Thus, the detailed descriptions for the exterior and the like of the circulation flow path frame 310 are omitted herein.

However, since the internal structure of the circulation flow path frame 310 corresponds to the structure of the first overflow path 320, the descriptions for the circulation flow path frame 310 will be replaced with the descriptions for the first overflow path 320.

The first overflow path 320 forms a flow path through which wash water stored at the bottom of the washing tub 10 moves upward to the top of the washing tub 10 and then discharged into the washing tub 10. The upward movement of the wash water is caused by water streams and centrifugal force generated by rotation of the pulsator.

Figure 16:
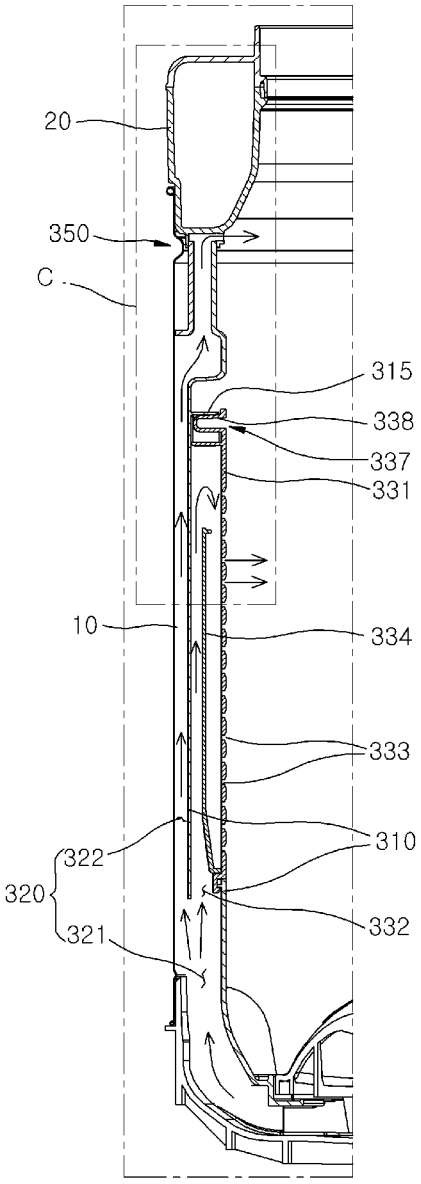
FIG. 16 is a cross-sectional view of the filter unit of the filter device for a washing machine in accordance with the third embodiment of the present invention along line A-A' of FIG. 8.

Referring to FIG. 12, when the circulation flow path frame 310 is on the inner wall of the washing tub 10, the first overflow path 320 is between the inner wall of the washing tub 10 and the circulation flow path frame 310, as illustrated in FIG. 16.

Figure 17:
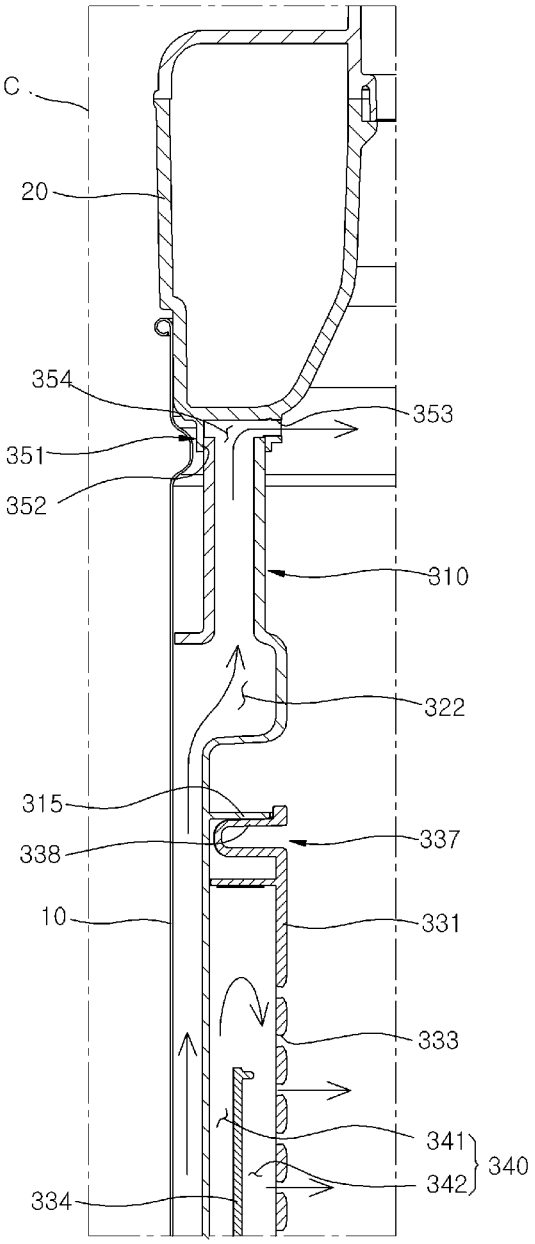
FIG. 17 is an exploded cross-sectional view of a portion C of FIG. 13.

Referring to FIGS. 16 and 17, the first overflow path 320 in accordance with the third embodiment of the present invention includes a lower flow path 321 and a vertical flow path 322. The lower flow path 321 forms the lower portion of the first overflow path 320, the spraying flow path 323 forms the upper portion of the first overflow path 320, and the vertical flow path 322 forms the middle portion of the first overflow path 320, connecting the lower flow path 321 and the spraying flow path 323.

The lower flow path 321 is in a space between the bottom of the inner wall of the washing tub 10 and the circulation flow path frame 310, and wash water stored in the washing tub 10 is entering the first overflow path 320 through the lower flow path 321. The bottom of the lower flow path 321 is open to allow in wash water.

The vertical flow path 322 is in a space between the inner wall of the washing tub 10 and the circulation flow path frame 310. The bottom of the vertical flow path 322 communicates with the top of the lower flow path 321, and the top of the vertical flow path 322 communicates with a balancer connection unit 350. The vertical flow path 322 has a smaller cross-sectional area than the lower flow path 321.

The wash water reaching the top of the lower flow path 321 moves upward through the first overflow path 320, or more particularly, the vertical flow path 322 or the second overflow path 340. That is, the flow path of wash water is divided into the vertical flow path 322 and the second overflow path 340 at the top of the lower flow path 321.

Thus, wash water discharged from the lower flow path 321, but not entering the second overflow path 340, moves upward through the vertical flow path 322 to reach the balancer connection unit 350. On the other hand, wash water discharged from the lower flow path 321, but not entering the vertical flow path 322, moves upward through the second overflow path 340.

Figure 15:
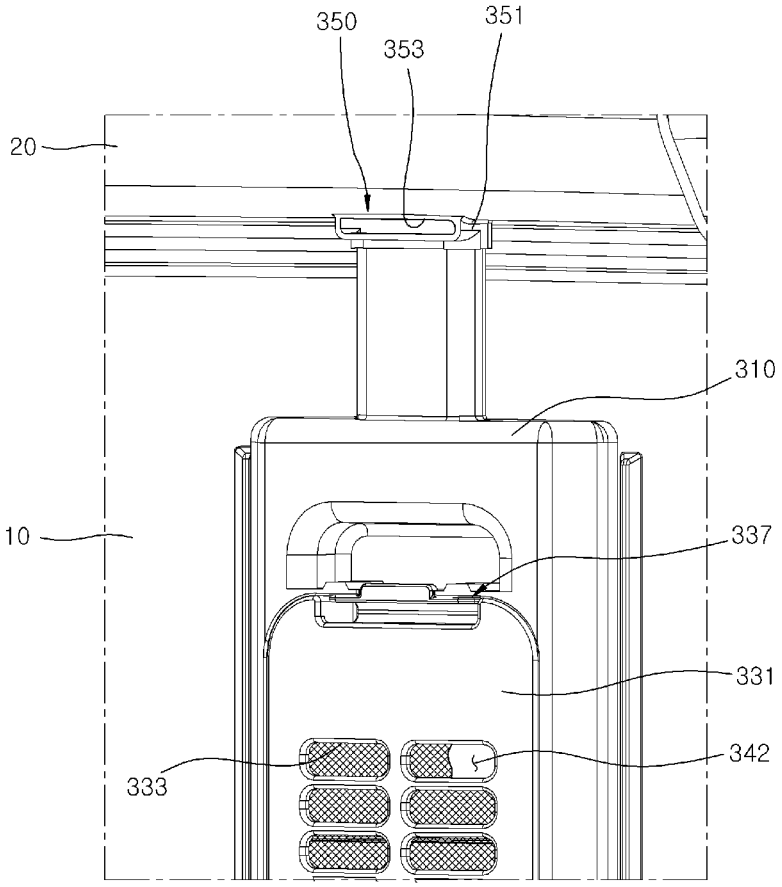
FIG. 15 is a perspective view of a portion B of FIG. 8.

Referring to FIGS. 15 to 17, the balancer connection unit 350 is under the balancer 20. The balancer connection unit 350 has a shape corresponding to an outer circumferential surface of an upper portion of the circulation flow path frame 310. Thus, the top of the circulation flow path frame 310 may be inserted and assembled to the balancer connection unit 350. The balancer connection unit 35 may be integral with the balancer 20.

The balancer connection unit 350 communicates with the inside of the washing tub 10, such that wash water reaching the top of the washing tub 10 through the first overflow path 320 is discharged into the washing tub 10. The balancer connection unit 350 communicating with the inside of the washing tub 10 has an open hole to discharge wash water.

The balancer connection unit 350 in accordance with the third embodiment of the present invention includes a connection body 351, a lower opening 352, and a side opening 353.

The connection body 351 is a frame forming the interior and exterior of the balancer connection unit 350, between the circulation flow path frame 310 and the balancer 20. The connection body 351 has a flow path therein, through which wash water supplied from the circulation flow path frame 310 is discharged into the washing tub 10.

The bottom portion of an internal flow path of the connection body 351 forms the lower opening 352. The lower opening 352 is connected to communicate with the first overflow path 320, which is the top of the vertical flow path 322. The top of the circulation flow path frame 310 is coupled to the connection body 351, while inserted into the lower opening 352.

A side portion of the inner flow path of the connection body 351 forms the side opening 353. The side opening 352 is connected to communicate with the inside of the washing tub 10. The side opening 353 may be formed through the bottom of the balancer 20 and the connection body 351.

The wash water reaching the top of the vertical flow path 322 enters the internal flow path of the connection body 351 through the lower opening 352. Then, the wash water moves through the internal flow path of the connection body 351 and then discharges into the washing tub 10 through the side opening 353.

The wash water moves upward when passing through the lower opening 352, but moves in a lateral direction when passing through the side opening 353. That is, the wash water reaching the top of the vertical flow path 322 moves upward through the lower opening 352, and then discharges toward the inside of the washing tub 10, while the flow direction of the wash water is changed to the lateral direction through the side opening 353. Thus, the wash water discharged through the side opening 353 is discharged in a horizontal direction with respect to the bottom surface of the washing tub 10.

The side opening 353 communicates with the lower opening 352 through a balancer connection flow path 354, and has a smaller cross-sectional area than the lower opening 352. Since the wash water that passed through the lower opening 352 is sprayed into the washing tub 10 through the side opening 353 having a smaller cross-sectional area, the wash water may be sprayed at a high speed. Thus, the area supplied with wash water may be increased. In the third embodiment of the present invention, the side opening 353 serves as a discharge port of the wash water through the first overflow path 320 and the balancer connection unit 350. That is, the discharge port of the balancer connection flow path 354 is above the discharge port of the second overflow path 340.

Referring back to FIGS. 11 and 12, the filter unit 330 is on the circulation flow path frame 310, and has the second over flow path 340 formed therein. The filter unit 330 has an opening 332 communicating with the first overflow path 320 (see FIG. 16).

Referring to FIGS. 13 and 14, the filter unit 330 in accordance with the third embodiment of the present invention includes a case 331, a partition wall 334, and a filter 336.

The case 331 has a space including the second overflow path 340, and forms a frame which may be mounted on the inner wall of the circulation flow path frame 310. The case 331 has an opening 332 at the bottom thereof, through which wash water may enter.

The case 331 has an open hole 333 at a surface facing the inside of the washing tub 10, that is, at the inner wall thereof, such that wash water is discharged into the washing tub 10 through the open hole 333. The case 331 may include a plurality of open holes 333 formed from the top to the bottom thereof. In the third embodiment of the present invention, the open holes 333 serve as the discharge ports of the second overflow path 340.

In the third embodiment of the present invention, the case 331 has a rectangular parallelepiped shape excluding the outer wall and bottom wall, and has a space in which the second overflow path 340 is formed.

The circulation flow path frame 310 has a depression 311 thereon. The depression 311 has a size corresponding to the shape of the case 331, such that the case 331 is mounted in the depression 311. Furthermore, the circulation flow path frame 310 has an assembling bump 315 at the top of the depression 311 that horizontally protrudes to the inside of the washing tub 10. Furthermore, the circulation flow path frame 310 has a locking bump (not illustrated) at the bottom of the depression 311 that protrudes upward.

The case 331 includes a detachable assembling part 337 at the top thereof, having a flexible width. Furthermore, the case 331 includes a protruding bump (not illustrated) at the bottom thereof.

The case 331 is assembled by the following process. First, the protruding bump locks to the locking bump of the circulation flow path frame 310, and the case 331 is pushed into the depression 311 of the circulation flow path frame 310. Then, as illustrated in FIG. 11, the case 331 may be installed on the circulation flow path frame 310. The detachable assembling part 337 is attaches directly to the assembling bump 315 at the bottom of the assembling bump 315.

The detachable assembling part 337 is curved from the outer wall to the inner wall of the case 331. According to the degree that the detachable assembling part 337 is curved, the width of the hollow portion in the detachable assembling part 337, that is, the width expanded and contracted in a vertical direction is determined.

The detachable assembling part 337 has a contact part 338 contacted with the assembling bump 315. The vertical length of the flexible contact part 338 is changed by pressure applied in a vertical direction. Thus, as downward pressure is applied to the detachable assembling part 337 to reduce the vertical length of the detachable assembling part 337, the contact part 338 separates from the assembling bump 315, and the filter unit 330 may be conveniently removed from the depression 311 of the circulation flow path frame 310.

Furthermore, since the contact part 338 elastically presses the assembling bump 315 where the filter unit 330 is mounted in the depression 311 of the circulation flow path frame 310, the filter unit 330 and the circulation flow path frame 310 may be reliably coupled to each other without a gap therebetween.

Referring to FIGS. 13, 14, and 16, the partition wall 334 has a plate shape, and coupled to the case 331, such that a space is formed between the partition wall 334 and the case 331. The space between the case 331 and the partition wall 334 forms an inner flow path 342 of the second overflow path 340.

In other words, as the partition wall 334 is between the circulation flow path frame 310 and the case 331, an outer flow path 341 of the second overflow path 340 is between the partition wall 334 and the circulation flow path frame 310, and the inner flow path 342 of the second overflow path 340 is between the case 331 and the partition wall 334.

The partition wall 334 is to have a space from the top of the case 331. Thus, wash water entering the case 331 moves through the outer flow path 341 of the second overflow path 340, enters the space between the top of the case 331 and the partition wall 334, and then moves through the inner flow path 342 of the second overflow path 340.

The wash water moves upward through the outer flow path 341 of the second overflow path 340. Then, the wash water moves downward and the direction of the wash water changes to the inner flow path 342 of the second overflow path 340.

The outer flow path 341 of the second overflow path 340 is between the circulation flow path frame 310 and the partition wall 334, and the inner flow path 342 of the second overflow path 340 is in the space between the partition wall 334 and the case 331.

The filter 336 has a mesh structure capable of filtering foreign matter contained in the wash water. The filter 336 is between the case 331 and the partition wall 334, facing the open holes 333. The filter 336 is on the inner flow path 342 of the second overflow path 340.

Thus, foreign matter in the wash water entering the inner flow path 342 of the second overflow path 340 are filtered by the filter 336, and the wash water is discharged to the outside of the case 331 through the open holes 333 and then supplied into the washing tub 10. The filtered foreign matter is collected in the inner flow path 342 of the second overflow path 340.

As the plurality of open holes 333 are in a vertical direction, the wash water may be discharged through some of the open holes 333 even though other open holes 333 are clogged with the foreign matter collected by the filter 336. As the plurality of open holes 333 are formed, the discharging of wash water and the filtering of foreign matter may be continuously performed while foreign matter is collected.

The partition wall 334 is rotatably coupled to the case 331. More specifically, the partition wall 334 has a hinge 335 at the bottom thereof, such that the bottom of the partition wall 335 is rotatably hinged or coupled to the bottom of the case 331.

Thus, as the partition wall 334 is rotated in a direction away from the case 331 when the filter unit 330 is removed from the circulation flow path frame 310, the foreign matter collected by the filter 336 may be conveniently exposed.

When the partition wall 334 is pulled back and separated from the inner wall of the case 331, the foreign matter collected by the filter unit 330 may be exposed to the outside. Thus, the collected foreign matter may be easily and quickly removed. Furthermore, the inside of the filter unit 330 may be easily and quickly cleaned.

Referring to FIGS. 12, 16, and 17, the flow path of wash water has one flow path at the lower flow path 321, but is divided into the first and second overflow paths 320 and 340 at the top of the lower flow path 321.

The flow path of wash water is divided into the first and second overflow paths 320 and 340 by the inner wall of the circulation flow path frame 310. Based on FIG. 15, a right side of the inner wall of the circulation flow path frame 310 forms the first overflow path 320, and a left side of the inner wall of the circulation flow path frame 310 forms the second overflow path 340.

Some of the wash water reaching the top of the lower flow path 321 moves to the balancer connection unit 350 through the vertical flow path 322 of the first overflow path 320, and discharges into the washing tub 10. Some of the wash water reaching the top of the lower flow path 321 moves to the middle portion of the washing tub 10 at a position lower than the balancer connection unit 350, through the second overflow path 340, and then discharges into the washing tub 10.

Referring to FIG. 12, when the filter unit 330 is on the inner wall of the circulation flow path frame 310, the second overflow path 340 is between the inner wall of the circulation flow path frame 310 and the case 331 of the filter unit 330, as illustrated in FIG. 15.

Referring to FIGS. 16 and 17, the second overflow path 340 in accordance with the third embodiment of the present invention includes the outer flow path 341 and the inner flow path 342.

The outer flow path 341 is in the space between the inner wall of the circulation flow path frame 310 and the partition wall 334. The wash water reaching the top of the lower flow path 321 enters the outer flow path 341 through the opening 332 at the bottom of the filter unit 330, and then moves upward through the outer flow path 341.

The inner flow path 342 is between the partition wall 334 and the case 331. The flow direction of the wash water that moves upward through the outer flow path 341 changes 180 degrees when the wash water contacts the case 331 at the top of the case 331. That is, the flow direction of the wash water moving upward in the outer flow path 341 changes to the downward direction when the wash water contacts the case 331 at the top of the case 331. Then, the wash water moves downward through the inner flow path 342 and then is supplied into the washing tub 10 through the open holes 333 while being filtered through the filter 336.

In accordance with the third embodiment of the present invention, since the circulation of wash water may be realized through the first and second overflow paths 320 and 340 and the balancer connection unit 350, the wash water may be uniformly supplied to the upper portion and the middle portion of the washing tub 10. That is, wash water may be discharged from the upper portion of the washing tub 10 through the first overflow path 320 and the balancer connection unit 350, and wash water may be discharged from the middle portion of the washing tub 10 through the second overflow path 340. Thus, wash water from the bottom of the washing tub 10 may be uniformly circulated through the upper portion and the middle portion of the washing tub 10.

Furthermore, the wash water moved through the first overflow path 320 and the balancer connection unit 350 is sprayed at a high speed through a side opening 353. Thus, the wash water may be supplied to positions remote from the inner wall of the washing tub 10. Thus, as the area supplied with wash water is widened, laundry items may be uniformly wetted with the wash water, making it possible to improve the washing performance of the washing machine.

Furthermore, since foreign matter contained in the wash water discharged through the second overflow path 340 are filtered through the filter 336, the wash water from which the foreign matter is removed may be supplied to improve the washing performance of the washing machine.

Furthermore, even when the depth of wash water is low, or a water pressure or centrifugal force formed by rotation of the pulsator is weak and the wash water does not reach the top of the washing tub 10, the wash water may be circulated through the second overflow path 340 formed in the middle portion of the washing tub 10. Thus, the washing performance of the washing machine may be improved.

Although some embodiments have been provided to illustrate the invention in conjunction with the drawings, it will be apparent to those skilled in the art that the embodiments are given by way of illustration only, and that various modifications and equivalent embodiments can be made without departing from the spirit and scope of the invention. The scope of the invention should be limited only by the accompanying claims.

The invention claimed is:

1. A filter device for a washing machine, comprising:

a circulation flow path frame on an inner wall of a washing tub, having a first overflow path is between the circulation flow path frame and the inner wall of the washing tub; and a filter unit on the circulation flow path frame, having a second overflow path between the filter unit and the circulation flow path frame and communicating with the first overflow path, wherein wash water entering the first overflow path is discharged into the washing tub through a discharge port of the first overflow path, the wash water entering the second overflow path is discharged into the washing tub through a discharge port of the second overflow path, the discharge port of the first overflow path is at a top of the washing tub, and the discharge port of the second overflow path is under the discharge port of the first overflow path, wherein the filter unit comprises:

a case on the circulation flow path frame, having an open hole at a surface facing the inside of the washing tub;

a substantially vertical partition wall coupled to the case, such that an outer flow path of the second overflow path is between the circulation flow path frame and the partition wall, and an inner flow path of the second overflow path is between the case and the partition wall; and a filter disposed detachably between the case and the partition wall that filters foreign matter in the wash water discharged into the washing tub through the open hole, and wherein a bottom of the partition wall is hinged to a bottom of the case.

2. The filter device of claim 1, wherein part of the wash water entering the first overflow path enters the second overflow path and is discharged into the washing tub through the discharge port of the second overflow path.

3. The filter device of claim 2, wherein the first overflow path comprises:

a lower flow path in a space between the inner wall of the washing tub and the bottom of the circulation flow path frame, and introducing the wash water stored in the washing tub;

a vertical flow path communicating with a top of the lower flow path, formed through a space between the inner wall of the washing tub and a middle portion of the circulation flow path frame, having a smaller cross-sectional area than the lower flow path, and extending upward to move the wash water from the lower flow path in an upward direction; and a spraying flow path communicating with a top of the vertical flow path, in a space between the inner wall of the washing tub and the top of the circulation flow path frame, and discharging the wash water from the vertical flow path into the washing tub, and the spraying flow path is above the filter unit.

4. The filter device of claim 2, wherein the first overflow path comprises:

a lower flow path in a space between the inner wall of the washing tub and the bottom of the circulation flow path frame, and introducing the wash water stored in the washing tub;

a vertical flow path communicating with a top of the lower flow path, formed through a space between the inner wall of the washing tub and a middle portion of the circulation flow path frame, having a smaller cross-sectional area than the lower flow path, and extending upward to move the wash water from the lower flow path in an upward direction; and a spraying flow path communicating with a top of the vertical flow path, in a space between the top of the circulation flow path frame and a balancer at the top of the washing tub, and discharging the wash water from the vertical flow path into the washing tub, and the spraying flow path is above the filter unit.

5. The filter device of claim 3 or 4, wherein the spraying flow path comprises:

a connection flow path communicating with the top of the vertical flow path and including an internal flow path curved towards an inside of the washing tub; and a discharge flow path communicating with the connection flow path, having a smaller cross-sectional area than the connection flow path, and discharging the wash water from the connection flow path into the washing tub.

6. The filter device of claim 5, wherein the top of the lower flow path communicates with the vertical flow path and the second overflow path, and the wash water discharged from the lower flow path diverges into the vertical flow path and the second overflow path.

7. The filter device of claim 6, wherein the outer flow path communicates with the top of the lower flow path and extends upward to move the wash water from the lower flow path in the upward direction, and the inner flow path communicates with a top of the outer flow path and extends downward to guide the wash water from the outer flow path to the open hole.

* * * * *